US006008763A

United States Patent [19]

Nyström et al.

[11] Patent Number: 6,008,763

[45] Date of Patent: Dec. 28, 1999

[54] FLAT ANTENNA

[75] Inventors: Ingela Nyström, Sundbyberg; Björn Lindmark; Dan Karlsson, both of Solna, all of Sweden

[73] Assignee: Allgon AB, Akersberga, Sweden

[21] Appl. No.: 08/854,660

[22] Filed: May 12, 1997

[30] Foreign Application Priority Data

May 13, 1996 [SE] Sweden ..... 9601819
Sep. 30, 1996 [SE] Sweden ..... 9603565

[51] Int. Cl.[6] ..... H01Q 21/24

[52] U.S. Cl. ..... 343/700 MS; 343/848; 343/767; 455/327

[58] Field of Search ..... 343/700 MS, 848, 343/767; 455/327

[56] References Cited

U.S. PATENT DOCUMENTS 4,929,959 5/1990 Sorbello et al. ..... 343/700 MS
5,030,961 7/1991 Tsao .
5,142,698 8/1992 Koga et al. ..... 455/327
5,241,321 5/1992 Tsao ..... 343/700 MS
5,309,164 5/1994 Dienes et al. ..... 343/700 MS
5,355,143 10/1994 Zurcher et al. .

FOREIGN PATENT DOCUMENTS 0520908 12/1992 European Pat. Off. .
2213995 8/1989 United Kingdom .

*Primary Examiner*—Don Wong
*Assistant Examiner*—James Clinger
*Attorney, Agent, or Firm*—Jacobson, Price, Holman & Stern, PLLC

[57] ABSTRACT

A flat aperture-coupled antenna with a multilayer structure is disclosed. A rear side of the antenna comprises a metal reflector device including a hollow structure (3, 5) with separate box-like compartments, located in registry with radiating patches, corresponding pairs of orthogonal slots and feed elements, whereby microwave propagation within the hollow metal structure is substantially interrupted and any mutual coupling between the orthogonal slots is avoided.

13 Claims, 3 Drawing Sheets

FLAT ANTENNA

BACKGROUND OF THE INVENTION

1. Field of the Invention

The present invention relates to a substantially flat aperture-coupled antenna, comprising a multilayer structure with a number of radiating patches arranged on a layer of dielectric material, a corresponding number of apertures, each in the form of two orthogonal slots, in a ground plane layer, and a corresponding number of feed elements in a feed network arranged on at least one planar board for feeding microwave energy from said feed elements, via said orthogonal slots to said radiating patches so as to cause the latter to form a microwave beam propagating from a front side of the antenna, a rear side thereof comprising a metal reflector device.

2. Description of the Invention

Flat aperture-coupled antennas are generally well-known in a variety of embodiments. Compare e.g. the U.S. Pat. Nos. 5,030,961 (Tsao), 5,241,321 (Tsao), 5,355,143 (Zürcher et al), and the European patent application, publ. no. 520908 (Alcatel Espace).

Often, the radiating patches are arranged in a matrix, i.e. a two-dimensional pattern with rows and columns, so that the antenna is extended over a surface area. Alternatively, the antenna may be provided with radiating patches disposed in a vertical row, possibly next to one or more similar antenna elements so as to form a multilobe antenna unit.

In such an antenna structure, including an array or a row of radiating patches and a reflector device at the rear side, there is a technical problem involved in that the reflector device will tend to function as a wave guide. Thus, resonances and an undesired coupling between the various apertures in the matrix will take place. Consequently, the intended beam configuration will be adversely affected, especially with regard to the dual polarization. Also, a substantial portion of the microwave energy fed into the antenna via the above-mentioned network may be lost by way of radiation outside of the forwardly directed beam as well as by heat absorption in the metal reflector device.

SUMMARY OF THE INVENTION

The antenna structure disclosed in the above-mentioned document EP520908 is somewhat different in that it does not include any orthogonal slots serving to isolate the dual polarized carrier waves and the associated signal channels from each other. Also, there is a sandwich structure including upper and lower metal plates and a thin dielectric plate with a feed network therebetween. The two metal plates have integral walls which together form cavities or compartments in the region of corresponding pairs of feed elements. However, the feed elements are unsymmetrically located in the respective cavities, and the two polarizations will therefore not be completely isolated from each other.

Against this background, the main object of the present invention is to avoid resonances and undesired coupling within the antenna and to substantially reduce losses of the microwave energy and to provide an antenna which is easy to assemble and is operationally efficient. A further specific object is to maintain an effective isolation between the separate channels obtained by the dual polarized carrier waves.

These objects are achieved in that the metal reflector device comprises a flat, hollow metal structure, comprising electrically separated, box-like compartments located in registry with the respective radiating patches, with the respective pair of orthogonal slots and with the respective feed elements, each such box-like compartment being confined between said ground layer as a top wall portion, a bottom wall portion and side wall portions extending between said top and bottom wall portions, whereby any microwave propagation within the hollow metal structure is interrupted and any mutual coupling between the orthogonal slots is avoided.

The electrically separated, box-like compartments may be formed in many different ways in practice. Some practical embodiments are indicated in the dependent claims 2–13 and will be discussed further below.

BRIEF DESCRIPTION OF THE DRAWINGS

The invention will now be explained more fully in conjunction with three embodiments illustrated on the appended drawings.

DETAILED DESCRIPTION OF THE PREFERRED EMBODIMENTS

Figure 1:
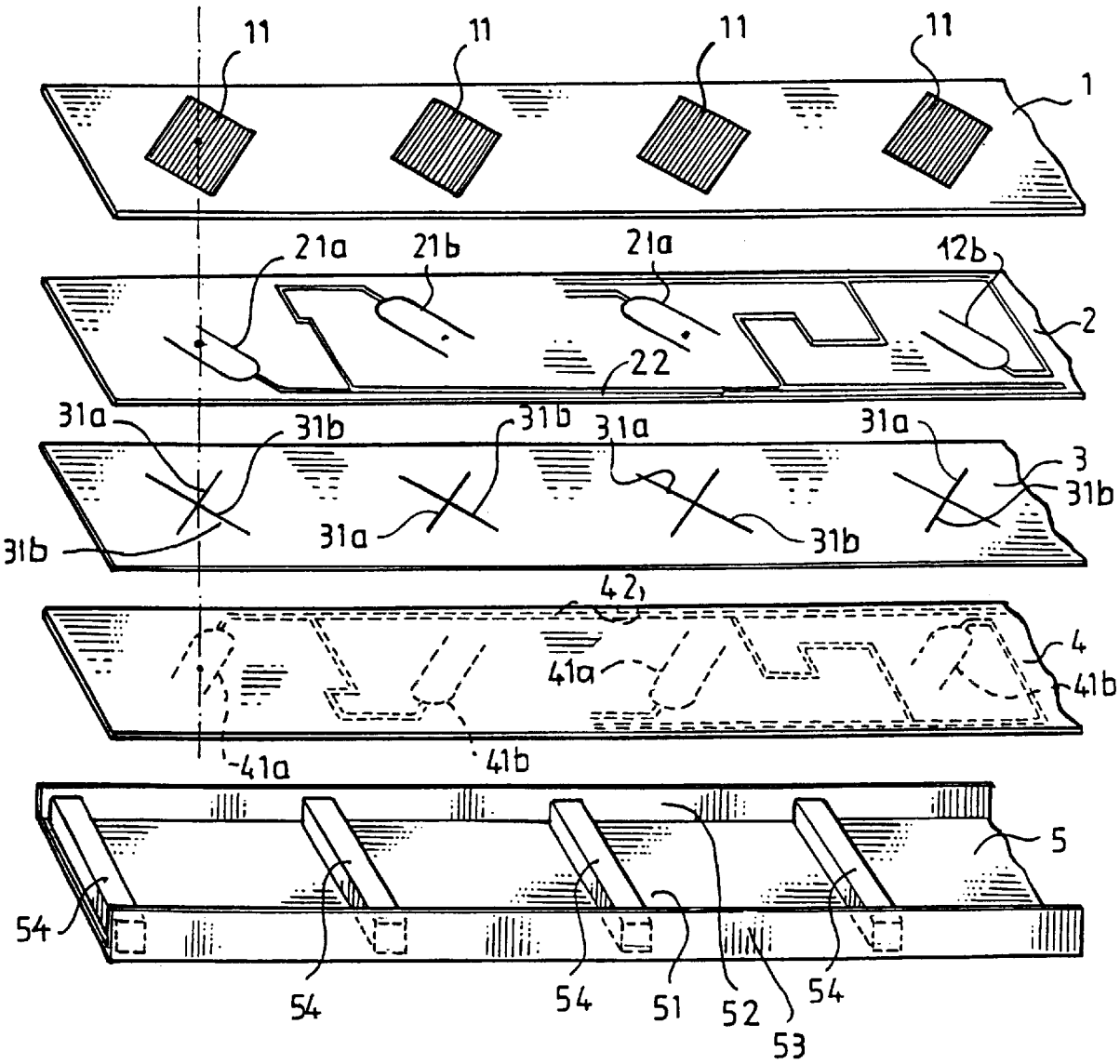
FIG. 1 shows, in an exploded perspective view, an end portion of an elongated antenna according a first embodiment of the present invention.

In the drawing figures, only the basic parts are shown which are essential to the basic functions of transmitting and receiving microwave energy containing communication signals. Accordingly, most of the necessary mechanical and electrical details are left out from the drawing figures.

The antenna comprises a multilayer structure. More particularly, in the first embodiment shown in FIG. 1, there are four layers 1, 2, 3 and 4, which are arranged one on top of the other and are laid down as a flat package onto a bottom unit 5. All the layers 1–4 have basically the same dimensions in terms of length and width and are secured at the top of the bottom unit 5 by mechanical means, for example into longitudinal grooves (not shown) in the bottom unit 5 or by special fasteners or snap-members (not shown).

The first layer 1 is made of dielectric material and is provided with a number of radiating patches 11 arranged in a longitudinal row, preferably with uniform mutual spacing. As is known per se, the patches are made of an electrical conducting material, such as copper or aluminium.

There are two layers 2 and 4, likewise made of dielectric material, which are provided with an upper part and a lower part, respectively, of a feeding network including upper feed elements arranged in pairs 21*a*, 21*b* being connected pairwise to a common feedline 22 in the form of a conducting strip, and lower feed elements 41*a* and 41*b* likewise being connected pairwise to a common feed strip 42 on the lower layer 4.

Between the layers 2 and 4, there is a ground plane layer 3 of conductive material, such as copper or aluminium, which is provided with a row of apertures in the form of crossing, mutually perpendicular slots 31*a*, 31*b*, each such pair of orthogonal slots being located in registry with a corresponding radiating patch 11 and a pair of feed elements 21*a*, 41*a* and 21*b*, 41*b*, respectively.

Microwave energy is fed through the conductive strips 22 and 42 to the various feed elements 21*a*, 41*a*, 21*b*, 41*b*, and a major portion of this energy is transferred or coupled via the orthogonal slots to the row of patches 11, from which a dual polarized microwave beam is transmitted in a well-defined lobe from the front side of the antenna (upwardly in FIG. 1). Typically, such a lobe will have a limited half-power beam width of 50–100° in the plane transverse to the longitudinal direction of the antenna. The beam width in the longitudinal direction will be determined by the size of the array, in particular the length of the elongated antenna. By placing a number of like antennas side by side, oriented with their longitudinal axes vertically, a multilobe antenna unit can be formed.

In accordance with the present invention, the bottom unit 5 forms, together with the ground plane layer 3, a hollow metal structure having electrically separated, box-like compartments. The hollow metal structure includes the ground plane layer 3 as a top wall, the rear metal wall 51 as a bottom wall as well as two side walls 52, 53. Preferably, the bottom unit 5 with the walls 51, 52 and 53, is made of aluminium.

The interior space within the hollow metal structure 3, 5 serves to accommodate the conductive strips 42 and possible other components of the antenna (such components are not shown in FIG. 1).

In order to prevent the generation of standing waves or other kinds of microwave propagation longitudinally inside the hollow metal structure 3, 5, a number of transverse partitions 54 are disposed at uniform spacing along the unit 5. The mutual distance between each pair of adjacent partitions 54 corresponds to the mutual distance between each pair of adjacent radiating patches 11. Accordingly, the hollow metal structure 3, 5 forms box-like compartments in registry with the respective radiating patches 11 and the associated feed elements 21*a*, 41*a* and pairs of orthogonal slots 31*a*, 31*b*.

The partitions 54 extend along the full width between the side walls 52 and 53. However, the height thereof is slightly less than the distance between the bottom wall 51 and the layer 4 so as to leave a free space therebetween. In any case, at least some of the partitions should cover only a part of the cross-sectional area of the box-like metal structure so as to accomodate the metal strips of the feeding network without making contact.

In the embodiment shown in FIG. 1, the partitions 54 are formed by separate metal pieces, for example made of aluminium, secured to the bottom wall 51 and/or the side walls 52, 53.

In order to provide the desired function of preventing longitudinal microwave propagation, the partitions 54 may be replaced by other forms of discontinuities in the bottom or side walls 51, 52, 53. It is important to avoid a constant cross section along the box-like structure which would then function as a wave-guide and cause resonances, undesired coupling as well as energy losses in the form of radiation and heat.

The ground plane layer 3 may be either mechanically connected to the bottom unit 5 or capacitively coupled thereto for the particular frequencies being used.

Figure 2:
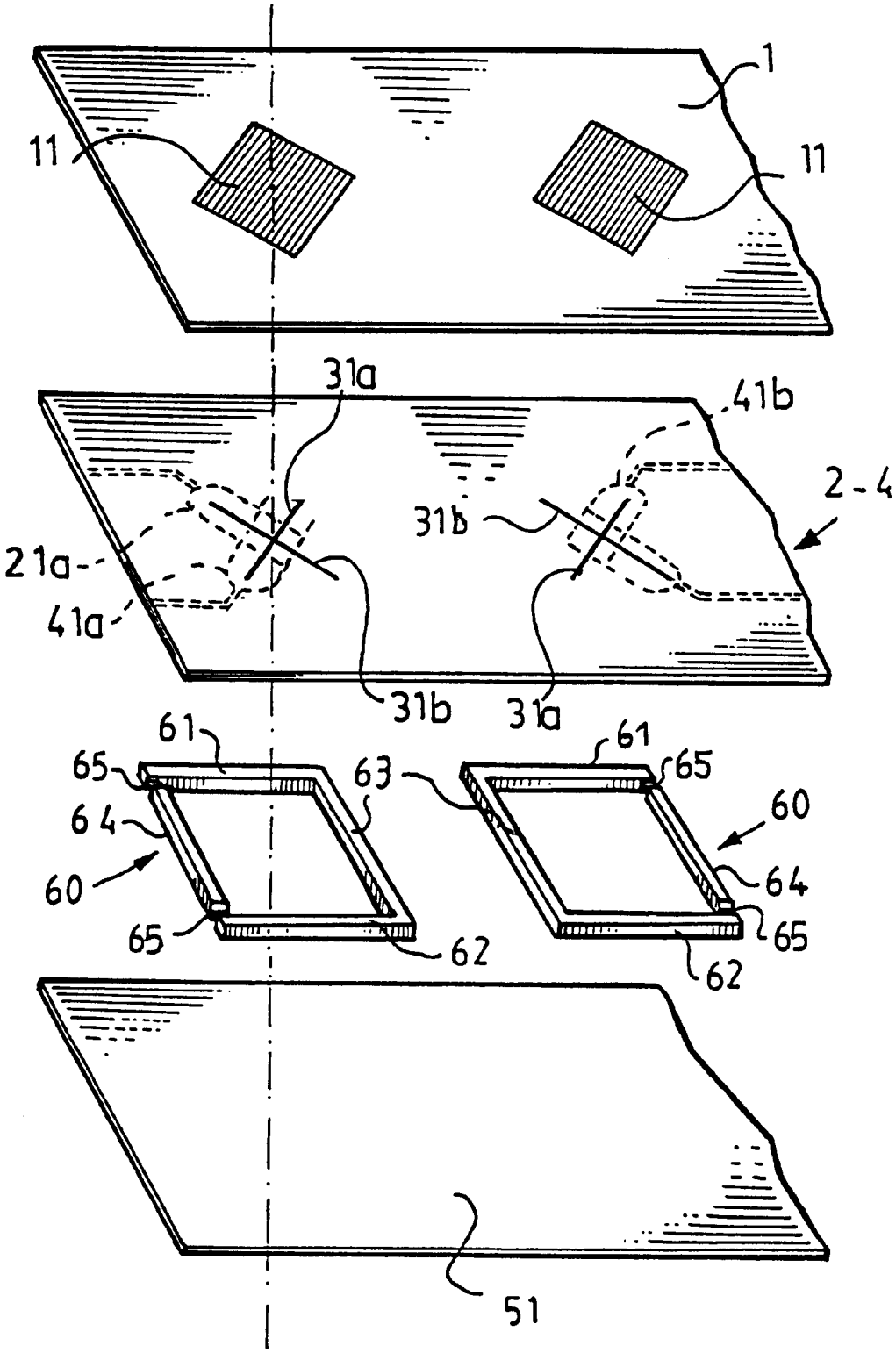
FIG. 2 shows a corresponding view of a second embodiment.

In the second embodiment, shown in FIG. 2, the multilayer structure with radiating patches 11, orthogonal slots 31*a*, 31*b* and feed elements 21*a*, 41*a*, 21*b*, 41*b* is basically the same as in FIG. 1. However, the hollow metal structure is different in that the box-like compartments are formed by substantially closed metal frames 60 interposed between the multilayer structure 1–4 and the rear wall 51.

Each frame 60 is located in registry with associated feed elements 21*a*, 41*a*, orthogonal slots 31*a*, 31*b* and patches 11. The frames 60 are distributed along the antenna in the longitudinal direction. In the respective frame 60, there are two opposite side wall portions 61, 62, a first transverse wall 63, and a second transverse wall 64. The latter is provided with openings 65 accommodating the feed network conduits connected to the feed elements 21*a*, 41*a*. Normally, such openings extend only partially through the wall. Generally, the openings or recesses may be located in one or more of the walls of each frame 60.

The frames 60 do not have to be electrically connected to the rear wall 51 or to the ground plane 3. However, it is essential that each wall element of the conducting frame 60 has such a width that it presents a significant capacitive coupling through the dielectric material of the multilayer structure to the ground plane 3. The frames will interrupt or reduce any microwave propagation outwards from the aperture in the region between the rear wall 51 and the multilayer structure. The frames may be mechanically connected to the multilayer structure 2–4. Moreover, the frames 60 in combination with the associated pair of orthogonal slots maintain an effective isolation between the two polarizations in each antenna element.

Figure 3:
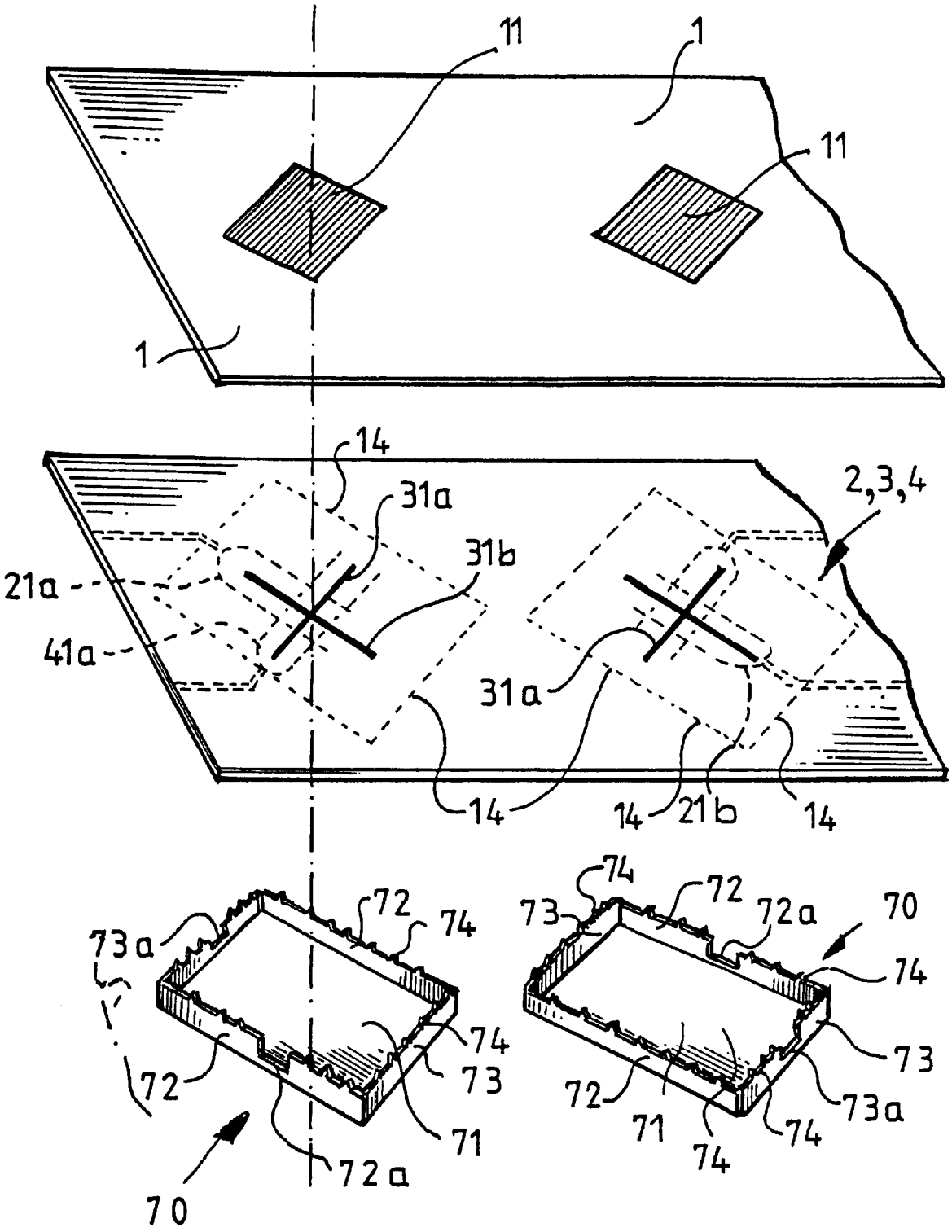
FIG. 3 shows a corresponding view of a third embodiment.

A third embodiment is shown in FIG. 3. It comprises a similar multilayer structure 1, 2, 3, 4 with radiating patches 11, orthogonal slots 31*a*, 31*b* and feed elements 21*a*, 41*a*, 21*b*, 41*b*. The metal reflector device, however, is different in that the box-like compartments are constituted by separate flat box units 70 at the rear side, each in registry with and centered in relation to a corresponding patch 11 and an associated pair of orthogonal slots.

Each flat box unit 70 has a rectangular bottom wall 71 and four side walls 72, 73. One side wall 72 has a recess 72*a* and another side wall 73 has a recess 73*a* for accomodating the feeding strips connected to the feed elements 21*a*, 41*a*, 21*b*, 41*b*.

The four side walls 72, 73 are provided with upwardly projecting pins 74, preferably formed at the time of punching a metal sheet into a metal blank. The flat box unit 70 is made from the blank by bending up the portions forming the side walls 72, 73.

The layers 1, 2, 3, 4 are provided with bore holes 14 in rectangular patterns corresponding to the projecting pins 74. At assembly, the projecting pins 74 are inserted upwards through the holes 14, whereupon the pins are soldered into direct electrical contact with the ground layer 3. In this way, the ground layer 3 will be securely connected mechanically as well as electrically to the flat box units 70.

The flat box units 70 may be substantially rectangular, square, polygonal or circular, as seen in a planar view.

It has turned out that the embodiment shown in FIG. 3 is very convenient to manufacture by punching, bending and soldering operations. Also, the functional qualities are excellent with a very effective isolation between the various patches and between the dual polarized carrier waves.

In all embodiments, as shown in the drawings, the orthogonal slots have to be positioned in such a symmetrical arrangement that the electromagnetic field components of the respective channel do not interfere with each other.

It is claimed:

1. A substantially flat aperture-coupled antenna having a front side, comprising a multilayer structure with a number of radiating patches arranged on a layer of dielectric material on a front side of the antenna, a corresponding number of apertures, each in the form of two mutually perpendicular slots, in a ground plane layer the perpendicular slots crossing each other at their mid-points and a corresponding number of feed elements in a feed network arranged on at least one planar board for feeding microwave energy from said feed elements, via said pairs of perpendicular slots to said radiating patches so as to cause the latter to form a dual polarized microwave beam propagating from the front side of said antenna, a rear side thereof comprising a metal reflector device, wherein said metal reflector device has a flat, hollow metal structure of electrically separated, box-like compartments aligned with the respective radiating patches, with the respective pair of perpendicular slots and with the respective feed elements each such box-like compartment positioned between said ground layer as a top wall portion, a bottom wall portion two opposite side wall portions extending between said top and bottom wall portions, and a conductive partition extending a complete distance between the two side wall portions, whereby any microwave propagation within said hollow metal structure is interrupted and any mutual coupling between said perpendicular slots is avoided.

2. The antenna as defined in claim 1 wherein said flat, hollow metal structure accommodates said feed elements.

3. The antenna as defined in claim 1, further comprising a transverse side wall portion extending substantially the complete distance between the two opposite side wall portions.

4. The antenna as defined in claim 1, wherein said conductive partition extends between each radiating patch.

5. The antenna as defined in claim 3, wherein said two side wall portions, said conductive partition and said transverse side wall portion form substantially closed frames defining said box-like compartments.

6. The antenna as defined in claim 3, the radiating patches arranged in a row, wherein said two opposite side wall portions extend substantially along the whole length of the antenna so as to define an elongated structure with said box-like compartments located in a corresponding row.

7. The antenna as defined in claim 6, wherein said conductive partition comprises a separate metal piece secured to said bottom wall portions and/or said two opposite side wall portions.

8. The antenna as defined in claim 1, wherein said box-like compartments are separate from each other.

9. The antenna as defined in claim 8, wherein the two opposite side wall portions are provided with upward projections which make contact with said ground plane layer.

10. The antenna as defined in claim 9, wherein said upward projections comprise pins extending through holes in said ground plane layer, the pins soldered to the holes.

11. An antenna as defined in claim 8, wherein each flat box unit has a substantially rectangular or square configuration.

12. The antenna as defined in claim 1 wherein said flat, hollow metal structure accommodates the perpendicular slots.

13. The antenna as defined in claim 1 wherein said flat hollow metal structure accommodates the feed elements.

* * * * *